US005836485A

United States Patent [19]

Plattner et al.

[11] Patent Number: 5,836,485

[45] Date of Patent: Nov. 17, 1998

[54] SLIDING GATE VALVE ASSEMBLY FOR A VESSEL CONTAINING MOLTEN METAL

[75] Inventors: Werner Plattner, Hünenberg; Walter Toaldo, Zug, both of Switzerland

[73] Assignee: Stopinc AG, Baar, Switzerland

[21] Appl. No.: 895,807

[22] Filed: Jul. 17, 1997

[30] Foreign Application Priority Data

Jul. 18, 1996 [CH] Switzerland ..... 1996 1808/96

[51] Int. Cl.[6] ..... B22D 41/08

[52] U.S. Cl. ..... 222/600

[58] Field of Search ..... 222/600, 597; 266/236

[56] References Cited

U.S. PATENT DOCUMENTS

| | | | |
|---|---|---|---|
| 3,352,465 | 11/1967 | Shapland | 222/600 |
| 3,786,969 | 1/1974 | Kelly | 222/600 |
| 4,077,552 | 3/1978 | Lothmann | 222/600 |
| 5,713,409 | 2/1998 | Stilli | 222/600 |

*Primary Examiner*—Scott Kastler

*Attorney, Agent, or Firm*—Wenderoth, Lind & Ponack, L.L.P.

[57] ABSTRACT

A sliding gate valve arrangement is provided with a molten metal vessel having an outlet and guide tracks secured to the vessel extending transverse to the outlet. The housing frame is slidably mountable on the guide tracks. The housing frame has a refractory base plate and a slider unit therein and a plurality of spring elements. The slider unit includes a refractory sliding plate that can be sealingly pressed into engagement with the refractory base plate with the spring elements. A drive element is connectable with the slider unit for moving the slider unit back and forth. The guide tracks are of a predetermined length such that the housing frame, when disposed on the guide tracks, is slidable over a predetermined distance between a first position in which the housing frame positions the refractory base plate and the slider unit below the outlet of the molten metal vessel and a second position in which the housing frame is released from the guide tracks and the molten metal vessel. A coupling is provided on the housing frame for engagement with the manipulator. The manipulator is used to move the housing frame and the guide tracks between the first and second positions for removing and installing the housing frame on the vessel.

34 Claims, 3 Drawing Sheets

84
92
91
10
81
82
62
80
40
20
85
22
83
88
86
87
89
90

SLIDING GATE VALVE ASSEMBLY FOR A VESSEL CONTAINING MOLTEN METAL

BACKGROUND OF THE INVENTION

1. Field of the Invention

The present invention relates to sliding valves for vessels containing molten metal. A housing frame has a refractory base plate and a refractory sliding plate mountable therein. The refractory sliding plate can be pressed against the refractory base plate by spring elements. The refractory sliding plate is arranged in a slider unit, and the slider unit is movable back and forth in the housing frame by a drive member.

2. State of the Prior Art

One known sliding gate valve is disclosed in patent publication DE-C 2523928. The sliding gate valve disclosed in this publication is suitable in particular for a converter forming a vessel containing molten metal. A sliding gate valve assembly is pre-assembled with known refractory wear parts, including a sliding plate, a base plate, and a discharge sleeve. The pre-assembled unit is secured by eye bolts and guide pegs to a frame attached to a tap of the converter. With this way of attaching the pre-assembled unit, it must be ensured that the projecting base plate in the valve engages in a groove of a front-most tap brick of a tapping passage in the converter, and that a sealed connection is sealed by mortar inserted between the front-most tap brick and the projecting base plate. The mortar subsequently hardens between them so that molten steel cannot leak out between the base plate and the tap brick. Leakage of liquid molten metal between the refractory components can result in the destruction of the entire sliding gate valve assembly.

The valve plates are required to be regularly replaced in this known sliding gate valve, because they are subjected to relatively intense wear. A certain amount of effort, however, is required for this type of replacement operation because the valve has to be removed from the hot converter and then opened. The plates have to be replaced, and the valve subsequently has to be reinstalled on the tap hole of the converter. Upon reinstallation, it again has to be ensured that the connection between the base plate and the refractory tap brick adjacent to the base plate are completely sealed with mortar.

SUMMARY OF THE INVENTION

It is the object of the present invention to provide a sliding gate valve of the type discussed above that is substantially removable from molten metal vessel and that can be installed on the molten metal vessel in a relatively simple manner and in an automated operation. It is a further object of the invention to ensure that the seal between a refractory base plate and a sliding plate, as well as between the refractory base plate and the head member adjacent to the refractory base plate, is complete.

In accordance with the present invention, a sliding gate valve arrangement is provided in which molten metal vessel has an outlet and guide tracks secured to the vessel extending transverse to the outlet. A housing frame is slidably mountable on the guide tracks. The housing frame has a refractory base plate and a slider unit therein as well as a plurality of spring packets or spring elements. The slider unit comprises a refractory sliding plate, and the refractory sliding plate is sealingly pressable into engagement with the refractory base plate by the spring elements. The drive element is connectable with the slider unit for moving the slider unit back and forth. The guide tracks have a predetermined length such that the housing frame, when disposed on the guide tracks, is slidable over a predetermined distance between a first position in which the housing frame positions the refractory base plate and the slider unit below the outlet of the molten vessel and a second position in which the housing frame is released from the guide tracks and the molten metal vessel.

A coupling is provided on the housing frame. A manipulator is connectable to the coupling of the housing frame for moving the housing frame on the guide tracks between the first position and the second position for the purpose of removing and installing the housing frame on the vessel.

The coupling preferably comprises a coupling peg, while the manipulator preferably comprises an actuating cylinder and a coupling sleeve attached to the actuating cylinder. The coupling peg and the coupling sleeve are connectable together to form a bayonet connection. The coupling peg and the coupling sleeve, furthermore, when coupled together, form a rigid connection.

The housing frame, furthermore, has sides having respective support arms thereon. The guide tracks are preferably L-shaped and preferably arranged parallel to one another. Each of the L-shaped tracks defines a guideway having an end portion lower than the guideway. Accordingly, the support arms can be guided onto the guideways.

The guide tracks define a means for sealing by pressing refractory sliding plate into engagement with the refractory base plate and the refractory base plate into engagement with the outlet through the spring elements when the manipulator is coupled to the coupling of the housing frame. The housing frame is moved by the manipulator into position by the guide tracks, and the manipulator moves the housing frame from the second position to the first position over the predetermined distance.

The outlet of the molten metal vessel has a flat lower surface for engagement with the refractory base plate. The guide tracks slope towards the flat lower surface from an open end thereof. Furthermore, the guide tracks preferably slope at a first rate and have an end portion at the open end thereof that slopes at a second rate greater than the first rate.

The vessel further comprises a first coupling part that is mounted thereon, and the housing frame preferably comprises a second coupling part mounted on the housing frame for connection with the first coupling part. One of the first and second coupling parts is a coupling sleeve, and the other is a member that is insertable into the sleeve. The coupling sleeve preferably has an internal dog, with the member having a notch for receiving the dog. One of the coupling sleeve and the member is rotatable between a position in which the coupling sleeve and the member are relatively movable and another position in which the internal dog engages the notch and the coupling sleeve and member are linearly fixed.

The coupling sleeve is preferably supported on the vessel by a bracket. The coupling sleeve further has an opening therein receiving a push rod therethrough. The member has a connecting portion therein connectable with the push rod. The push rod is connected with the drive element, and the connecting portion is connected with the slider unit.

The manipulator preferably has a gripper for engaging molten metal vessel for the purpose of positioning the manipulator relative to the vessel. The vessel includes an adaptor plate that surrounds the outlet, the adaptor plate having centering pegs thereon for engagement by the gripper.

The guide tracks and the spring packets are arranged such that the housing frame is not pressed by the spring packets due to contact with the guide tracks until shortly before the housing frame reaches the first position when moved from the second position to the first position by the manipulator. The support arms have a longitudinal extent along the sides of the housing frame, and the spring packets are distributed along the longitudinal extent of the support arms. The guide tracks have substantially the same longitudinal extent as the support arms.

The spring packets preferably comprise guide pegs having springs disposed thereon. The pegs have lower engagement surfaces for engagement with the guide tracks. The guide tracks have engagement surfaces for engagement with the lower engagement surfaces of the pegs. The lower engagement surfaces of the pegs define lines that are parallel to the guide tracks. The guide tracks extend at an acute angle relative to the direction of movement of the housing frame.

With the sliding gate valve assembly according to the present invention, the refractory plates, including the refractory base plate, the sliding refractory plate, and the refractory head member in the adapter plate, may be replaced without relatively time consuming manual work having to be performed on the hot molten metal vessel, especially if the vessel is a converter. When sliding gate valves are used on a converter, the fact that the refractory plates have a length up to 600 millimeters, or longer, must be taken into account. As such, they can hardly be replaced manually. This problem is also solved by the above features of the present invention.

BRIEF DESCRIPTION OF THE DRAWINGS

An example of a preferred embodiment of the present invention will be described below with reference to the accompanying drawings in which.

DETAILED DESCRIPTION OF THE PREFERRED EMBODIMENTS

Figure 1:
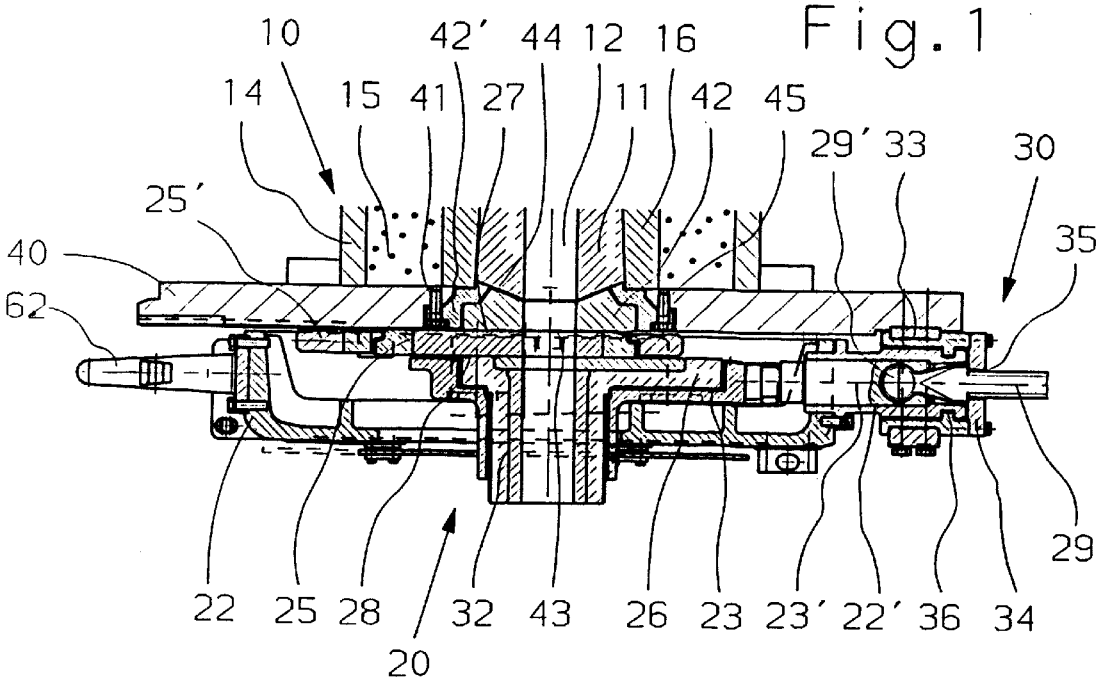
FIG. 1 is a longitudinal sectional view of a sliding gate valve assembly according to the present invention.

Referring initially to FIG. 1, a sliding gate valve 20 is provided at an outlet 12 of a vessel 10 containing molten metal. The vessel 10, in FIG. 1, is not specifically illustrated. However, the vessel is a converter in which the outlet 12 is arranged along an upper region of a sidewall of the vessel. When the vessel 10 is emptied, it is tilted to allow the molten metal to flow to the outlet 12. Subsequently, the molten metal flows through the outlet 12, also referred to as a tap, into a ladle or the like.

Of the vessel 10, only an outlet socket 14 is shown. The external surface of the socket 14 is metallic. Arranged inside the socket 14, shown in part, are a refractory inlet sleeve 11, a refractory sleeve 16 surrounding the sleeve 11, and a mortar bed 15. Otherwise, the vessel 10 is similar to the vessel illustrated in publication DE-C 2523928, discussed above.

An adapter plate 40 is removably mounted to an end surface of the outlet socket 14. The sliding gate valve assembly 20, in turn, is secured to the adaptor plate 40.

The sliding gate valve 20 includes a housing frame 22. The housing frame 22 houses a stationary refractory base plate 25 and a slider unit 23 holding a sliding plate 26. The sliding plate 26 is sealingly pressed against a lower sliding surface 28 of the refractory base plate 25. The slider unit 23 is moved back and forth by a drive element that is connected to a push rod 29. The push rod 29 is connectable to the slider unit 23. Accordingly, the sliding gate valve 20 can be moved into an open position as illustrated in FIG. 1, and into a closed position. The sliding plate 26 moves relative to the refractory base plate 25, accordingly.

Adjacent to the sliding plate 26 is a refractory discharge sleeve 32 through which molten metal flows out of the vessel 10 into a ladle or the like. It is noted that in use the sliding gate valve 10, with this arrangement, assumes only either an open position or a closed position with the converter vessel 10. There is therefore no controlled discharge of the volume of metal that flows out of the vessel 10.

The refractory base plate 25 has a plane upper slide surface 27 parallel to the lower sliding surface 28. The refractory base plate 25 is stationary in the direction of the lower sliding surface 28, but is disposed and arranged so as to be moveable in a direction perpendicular to the lower sliding surface 28 within the housing frame 22. Accordingly, the refractory base plate 25 is capable of being pressed against a refractory head member 42. The refractory head member 42 is securable to the outlet 12. As such, the refractory base plate 25 and the refractory head member 42 together define a sealed point of disconnection.

The refractory base plate 25 is enclosed within a cassette 25' that is mounted to be moveable in the housing frame 22 in a direction transverse to the longitudinal dimension of the plates, as discussed above. This arrangement makes the removal and installation of the housing frame from and to the vessel 10, together with the slider unit 23 and plates 26 and 28, possible.

Guide tracks 52 are attached to the adapter plate 40 on the vessel 10 and extend in a direction transverse to the outlet 12 of the vessel. The housing frame 22 is mounted together with the sliding plate 26 and the refractory base plate 25 beneath the outlet 12 so as to be longitudinally moveable on the guide tracks 52. The housing frame 22 is capable of being moved a predetermined distance from its mounted position so as to move to a release position.

On one end of the housing frame 22 is a coupling peg 62. The coupling peg 62 forms a means for connecting the housing frame 22 to a manipulator 80 (to be described later). The manipulator 80 can thus be used, by engagement with the peg 62, to move the housing frame 22 into a outer position on the guide tracks 52. Preferably the coupling peg 62, in its connection with the manipulator 80, forms a rigid bayonet connection.

The refractory head member 42 referenced above is an annular member that has a flat end surface 43 on its underside and a circular groove 44 on an upper surface thereof. An annular projection on the discharge sleeve 11 fits into the circular groove 44. Between the end of the discharge sleeve 11 and the circular groove 44 is preferably provided a setting mortar. A flange 42' surrounds the head member 42.

The flange 42' is fixed from below in an annular recess 41 of the adapter plate 40 by a suitable fastening arrangement 45, such as bolts. When the sliding gate valve assembly 20 is removed along with the housing frame 22, the head member 42 can also be released and replaced. In the assembled state, the lower flat end surface 43 of the head member 42 projects beyond, i.e. below, the lower surface of the adapter plate 40. This thus permits the flat end surface 43 to contact the upper surface 27 of the refractory base plate 25. It is noted that the upper surface 27 of the refractory base plate 25 projects beyond, i.e. above, the housing frame 22.

High grade refractory inserts, for example comprising zirconia, may be embedded in a refractory base material of each of the refractory base plate 25, the sliding plate 26, and a discharge sleeve 32. Furthermore, a metallic band may surround the refractory base material.

Figure 2:
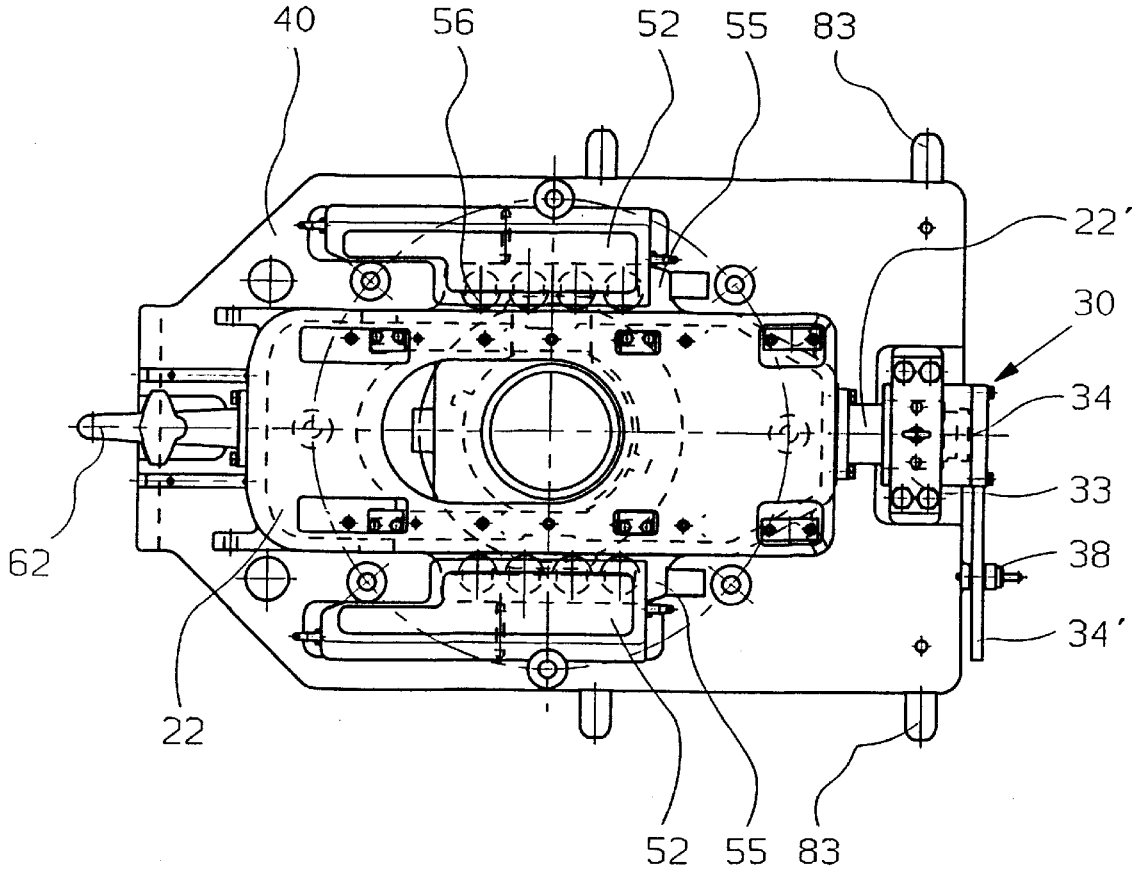
FIG. 2 is a bottom view of the sliding gate valve assembly of FIG. 1.

A coupling device 30 is illustrated at the right hand side of each of FIGS. 1 and 2. The coupling device 30 is secured to the adapter plate 40. It is used to connect the slider unit 23 to the push rod 29 after the housing frame 22 has been slid into position beneath the outlet 12, and at the same time to fix the housing frame 22 to the vessel 10.

Figure 5:
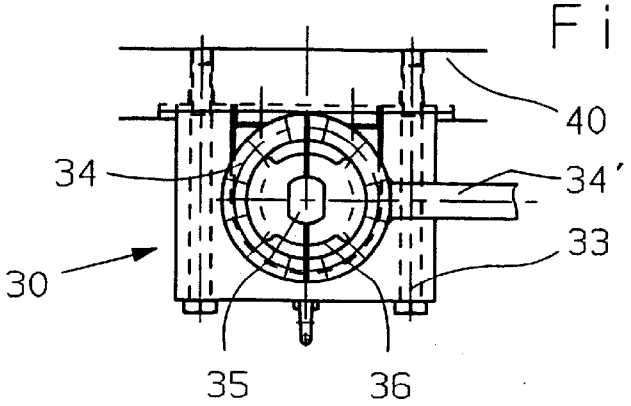
FIG. 5 is an end view of a coupling arrangement according to the present invention.

A bracket 33 is secured to the adapter plate 40, as best illustrated in FIG. 5. It may be secured to the adapter plate by any appropriate fastener, such as bolts. A coupling sleeve 34 is pivotally mounted in the bracket 33 for rotational movement above an axis parallel with the longitudinal direction of movement of the housing frame 22 on the guide tracks 52. The coupling sleeve 34 has an opening 35 therein which receives the push rod 29 therethrough. The coupling sleeve furthermore has an inner surface provided with dogs 36 or other appropriate detent members for engagement with the housing frame 22. The housing frame 22 has an end member 22' that is connected to the end of the housing frame 22 and extends into the coupling sleeve 34, as illustrated in FIG. 1. Rotation of the coupling sleeve 34 is one direction allows the member 22' to be inserted therein. Rotation in another direction causes the dogs 36 to engage corresponding notches in the member 22' to longitudinally fix the member 22', and thus the housing frame 22, relative to the adapter plate 40. It is noted that the member 22' can be separately fixed to the end of the longitudinal housing as shown in FIG. 1. The member 22' further has an interior passage through which extends a connecting portion 23'. The connecting portion 23' is connected to the slider unit 23 and coupled to the push rod 29 by a ball 29' on the front end of the push rod 29.

Figure 3:
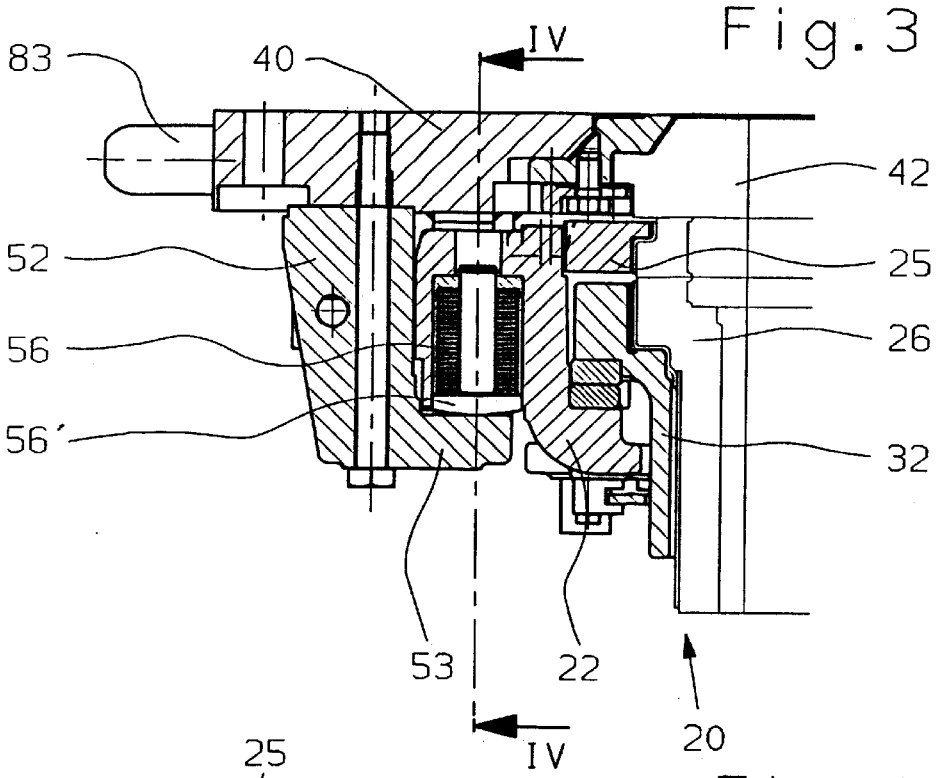
FIG. 3 is a partial cross-sectional view of a sliding unit mounted on guide tracks of an adapter plate of the sliding gate valve assembly according to the present invention.

Referring now to FIGS. 2 and 3 in particular, the adapter plate 40, which is fastened to the vessel 10 by means of bolts or similar fasteners, has two L-shaped guide tracks 52 mounted thereon. The guide tracks 52 are parallel to one another, and each has an inner guideway 53 for supporting a respective support arm 55 projecting from a housing frame 22.

The two support arms 55, as can be best seen from FIG. 2, extend laterally from the two longitudinal sides of the housing frame 22. Mounted in the two support arms 55 are respective pluralities of spring packets, disposed one next to the other. Each spring packet comprises a guide peg 56' and a plurality of plate springs 56 thereon. These can best be seen in FIG. 4, in which the lower surfaces of the guide pegs 56', also referenced as engaging surfaces, engage the guideway 53. The plate springs 56 produce an axial pressure on the guide pegs 56', thus pushing the housing frame 22 upwardly relative to the inner guideways 53.

In the illustrated state of the sliding gate valve assembly 20, the various plate springs 56 are under compression, producing a force in the upward direction in the housing frame 22. This force is transferred, as can be seen from the arrangement illustrated in FIG. 3, through the housing frame 22 to the slider unit 23 and the refractory plates 25 and 26. Consequently, this force is transmitted to the lower surface of the refractory head member 42 mounted in the adapter plate 40. By this pressure being exerted in the mounted position of the housing frame 22, it is ensured that no molten metal can leak out between the refractory plates 25 and 26 and between the head member 42 and the refractory base plate 25 when molten metal is poured through the outlet 12.

Figure 6:
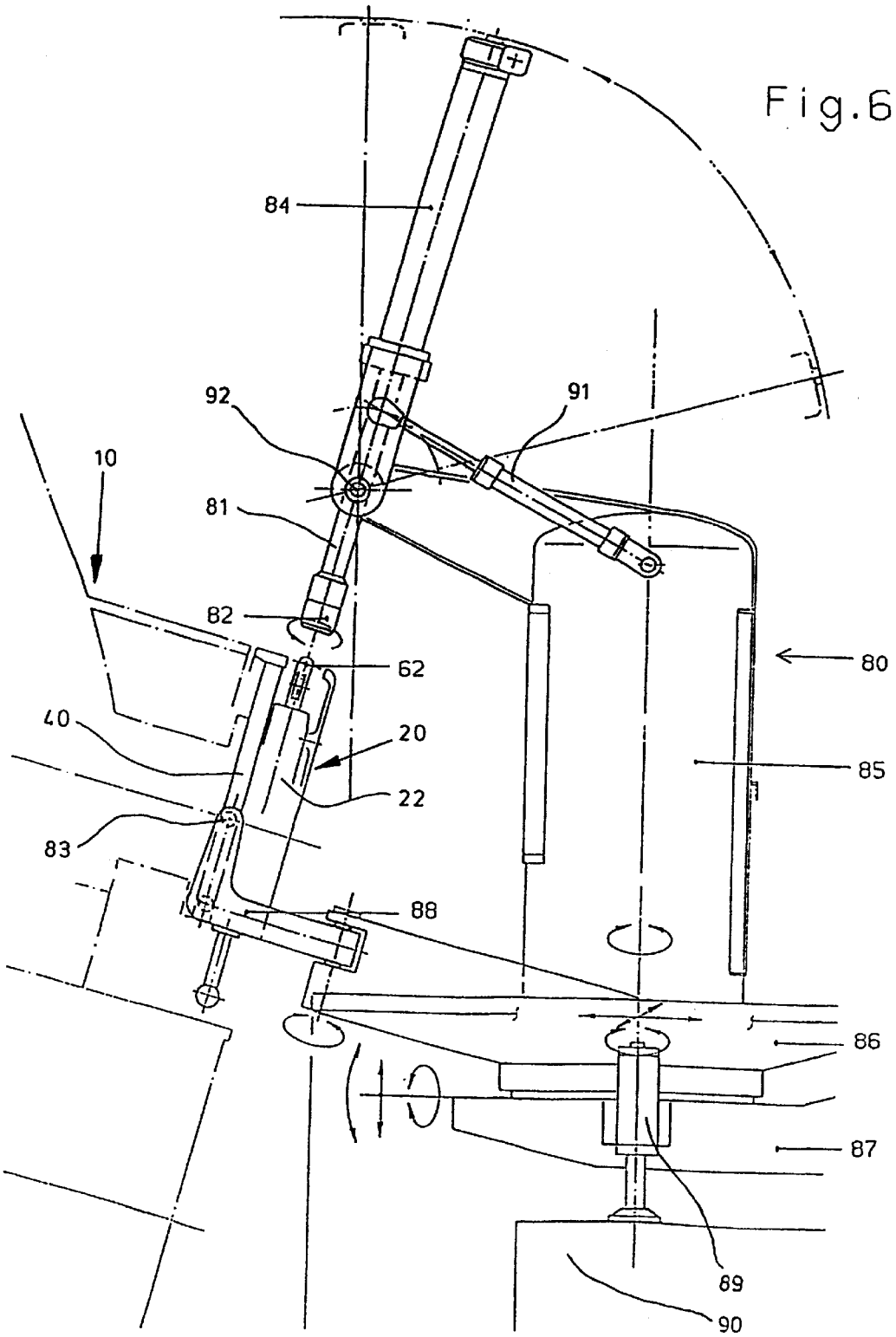
FIG. 6 is a schematic view of a manipulator, a molten metal vessel and the sliding gate valve assembly according to the present invention.

A manipulator 80 is illustrated in FIG. 6 and will be described in more detail hereinbelow. The housing frame 22 can be removed from the vessel 10 in the longitudinal direction of the guide tracks 53 with the manipulator 80 connected with the coupling peg 62. In order to release the housing frame 22 for the purpose of removing the housing frame 22, the coupling sleeve 34 first has to be rotated 90° with the manually operated lever 34', releasing the member 22' and the connecting portion 23', and releasing the push rod 29 from the slider unit 23. The housing frame 22 is then movable to the left as seen in FIGS. 1 and 2. As soon as the support arms 55 are out of engagement with the guide tracks 52, the housing frame 22 can be removed from the vessel and taken to an assembly station remote from the hot converter. The refractory plates can then be replaced.

Figure 4:
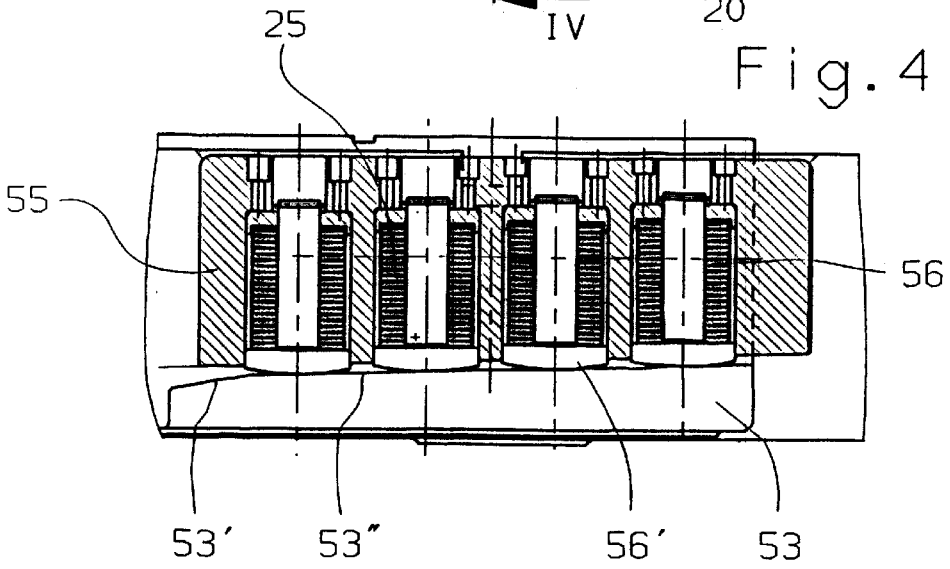
FIG. 4 is a longitudinal sectional view showning details of support arms of the housing frame mounted on the guide tracks of FIG. 3.

The interaction between the support arms 55 and the guide tracks 52 will now be discussed in more detail. As shown in FIG. 4, four spring packets, which are of the same dimensions and arranged in a row, are provided for each support arm 55. They are, furthermore, arranged in the support arms 55 so that they are all set with respect to one another in a stepped manner in order that the lower engagement surfaces of the guide pegs 56' of the spring packets will define a line. This line extends parallel to an engagement surface 53" of the guideway 53. The engagement surface 53" extends at an angle relative to the planes of the refractory members, in particular, the plane perpendicular to the axes of the outlet 12, i.e. a plane parallel to the lower surface of the refractory head member 42, the surfaces of the refractory base plate 25 and the sliding surface of the refractory sliding plate 26. The angle is an acute angle of only about one to two degrees. Accordingly, when moving the housing frame 22 into the illustrated operational state, the spring packets 56 are stressed by the oblique arrangement of the engagement surfaces only shortly before the illustrated end position of the housing frame 22. For example, the spring packets 56 might only be stressed by the oblique arrangement of the engagement surfaces a distance corresponding to the distance between two spring packets before the housing frame reaches the end position, i.e. immediately before the end position.

The result of this arrangement is that the pressing of the upper slide plane surface 27 of the refractory base plate 25 against the lower end surface 43 of the refractory head member 42 is effected only over a short distance, close to the operational position.

The guideway 53 of the guide tracks 52 is further provided with an entry ramp 53'. This ramp has a greater rate of inclination, making it easier to introduce the housing frame 22 into the guide tracks 52.

FIG. 5 illustrates more particularly the arrangement of the coupling sleeve 34. As discussed before, the coupling sleeve 34 has an opening 35 receiving the push rod 29 therethrough. The front end ball 29' is provided with lateral flat members that are adapted to be introduced into a corresponding recess in the connecting portion 23' of the slider unit 23. When the lever 34' is directed downwardly, and the housing frame 22 is installed by moving the housing frame 22 to the operational position, the member 22' on the end of the housing frame 22 moves into the coupling sleeve 34. The connecting portion 23' correspondingly engages with the front end ball 29' of the push rod 29. As soon as the housing frame 22 has been pushed into the end position, the coupling sleeve 34 is rotated by 90° by the lever 34'. This also rotates the push rod 29 through 90°, causing the lateral flats of the push rods 29 to be engaged with the connecting portion 23'. At the same time, the coupling sleeve 34 has the dogs or other engagement members thereof engaged with the corresponding notch or notches of the member 22'. The lever 34' can then be secured against rotation with a locking member 38 (for example a clamp) as shown in FIG. 2. From this position, the push rod 29 can operate the slider unit 23 through the coupling sleeve 34 and the member 22'. The slider unit 23 is moved by a suitable drive element, such as a hydraulic drive.

The above sequence is reversed when it is desired to remove the housing frame 22.

As noted above, FIG. 6 shows a manipulator 80 according to the present invention. The manipulator 80 includes a manipulator support 86 that can be moved horizontally in any direction and that can be rotated about its axis, as illustrated by the arrows shown in the figure. A stacker truck 87, or similar device, is used to support the manipulator support 86. Illustrated is a fork of the stacker truck 87. The fork can be moved in any one of the directions shown in the figure, i.e. it can be pivoted, rotated, or moved up and down.

A control cabin 85 is mounted on the manipulator support 86. Connected with the control cabin 85 is an actuating cylinder 84. The manipulator support 86 further has vertically adjustable support legs 89 used to support the manipulator support on a platform 90 as appropriate and desired.

A gripper 88 is pivotally connected to the manipulator support 86. The gripper 88 is used to determine the position of the manipulator 80 relative to the molten metal vessel 10. This is done by moving the gripper 88 to engage centering pegs 83 provided on the adaptor plate 40, which pegs are for example illustrated in FIGS. 2 and 3. The pegs 83 are preferably provided on both sides of the plate 40. Accordingly, the manipulator 80 can determine the spatial position of the molten metal vessel 10 using the gripper 88 to engage the centering pegs 83.

The actuating cylinder 84 is pivoted about a horizontal axis through a rotary mounting 92 on the cabin 85. A cylinder unit 91 is used to pivot the actuating cylinder 84 about the horizontal axis. A piston rod 81 extends from the actuating cylinder 84, and has on its end a coupling socket 82. The coupling socket 82 is rotatable about its axis and can be moved over the coupling peg 62 on the housing frame 22 and be coupled to the coupling peg 62 by rotation. After the housing frame 22 has been coupled to the actuating cylinder 84 through the coupling peg 62 and the coupling socket 82, the housing frame 22 can be removed by axial movement of the piston rod 81.

The housing frame 22 is then taken to an assembly station for a replacement of the refractory components. The manipulator 80 is moved by the stacker truck 87 to a position as preferably shielded from heat and dirt.

While the present invention has been described above in connection with the preferred embodiment and a specific example, it should be emphasized that variations of the above features will occur to those skilled in the art. Such variations should be considered within the scope of the present invention.

For example, the spring packets that are integrated in the housing frame 22 along the support arms 55 of the housing frame could also be arranged in the guide tracks 52 through use of known tilting levers, whereby the tilting levers would define guideways 53. Furthermore, sliding gate valve assembly in accordance with the present invention is also basically suitable for use with discharge regulation of electric furnaces, a ladle used in continuous casting installations, and a distributor vessel.

We claim:

1. A sliding gate valve arrangement, comprising:

a molten metal vessel having an outlet and guide tracks secured to said vessel extending transverse to said outlet;

a housing frame slidably mountable on said guide tracks, said housing frame having a refractory base plate and a slider unit therein and a plurality of spring elements, said slider unit comprising a refractory sliding plate, and said refractory sliding plate being sealingly pressable into engagement with said refractory base plate by said spring elements;

a drive element connectable with said slider unit for moving said slider unit back and forth;

wherein said guide tracks have a predetermined length such that said housing frame, when disposed on said guide tracks, is slidable over a predetermined distance between a first position in which said housing frame positions said refractory base plate and said slider unit below said outlet of said molten metal vessel and a second position in which said housing frame is released from said guide tracks and said molten metal vessel;

a coupling on said housing frame; and a manipulator connectable with said coupling of said housing frame for moving said housing frame on said guide tracks between said first position and said second position for removing and installing said housing frame on said vessel.

2. The sliding gate valve of claim 1, wherein said coupling comprises a coupling peg, said manipulator comprises an actuating cylinder and a coupling sleeve attached to said actuating cylinder, said coupling peg and said coupling sleeve are connectable together to form a bayonet connection, and said coupling peg and said coupling sleeve, when coupled together, form a rigid connection.

3. The sliding gate valve of claim 1, wherein:

said housing frame comprises sides having respective support arms thereon; and said guide tracks are L-shaped and arranged parallel to one another, each of said L-shaped guide tracks defining a guideway having an end portion lower than said guideway, whereby said support arms can be guided onto said guideways.

4. The sliding gate valve of claim 1, wherein said guide tracks define a means for sealingly pressing said refractory sliding plate into engagement with said refractory base plate and said refractory base plate into engagement with said outlet through said spring elements when said manipulator is coupled with said coupling of said housing frame, said housing frame is moved by said manipulator into position between said guide tracks, and said manipulator moves said housing frame from said second position to said first position over said predetermined distance.

5. The sliding gate valve of claim 1, wherein said outlet of said molten metal vessel has a flat lower surface for engagement with said refractory base plate, and said guide tracks slope toward said flat lower surface from an open end thereof.

6. The sliding gate valve of claim 5, wherein said guide tracks slope at a first rate and have an end portion at said open end thereof that slopes at a second rate greater than said first rate.

7. The sliding gate valve of claim 1, wherein said vessel further comprises a first coupling part mounted thereon and said housing frame further comprises a second coupling part mounted thereon for connection with said first coupling part.

8. The sliding gate valve of claim 7, wherein one of said first and second coupling parts comprises a coupling sleeve and the other of said first and second coupling parts comprises a member insertable into said sleeve.

9. The sliding gate valve of claim 8, wherein said coupling sleeve comprises an internal dog, said member comprises a notch for receiving said internal dog, and one of said coupling sleeve and said member is rotatable between one position in which said coupling sleeve and said member are relatively movable and another position in which said internal dog engages said notch and said coupling sleeve and said member are linearly fixed.

10. The sliding gate of valve of claim 8, wherein said coupling sleeve is supported on said vessel by a bracket and has an opening therein receiving a push rod there through, said member has a connecting portion therein connectable with said push rod when said housing frame is mounted on said guide tracks by said manipulator, said push rod is connected with said drive element, and said connecting portion is connected with said slider unit.

11. The sliding gate valve of claim 1, wherein said manipulator further comprises a gripper and said vessel further comprises a means for engaging said gripper and thereby positioning said manipulator relative to said vessel.

12. The sliding gate valve of claim 11, wherein said vessel includes an adapter plate surrounding said outlet and said means for being engaged comprise centering pegs disposed on sides of said adapter plate.

13. The sliding gate valve of claim 1, wherein:

said housing frame comprises support arms holding said spring elements;

said spring elements are disposed between said guide tracks and said support arms to press said housing frame toward said vessel outlet when said housing frame is in said first position; and said guide tracks and said spring elements are arranged such that said housing frame is not pressed by said spring elements due to contact with said guide tracks until shortly before said housing frame reaches said first position when moved from said second position to said first position by said manipulator.

14. The sliding gate valve of claim 13, wherein said support arms have a longitudinal extent along sides of said housing frame, said spring elements are distributed along said longitudinal extent of said support arms, and said guide tracks have substantially the same longitudinal extent as said support arms.

15. The sliding gate valve of claim 13, wherein:

said spring elements comprise guide pegs having springs disposed thereon;

said pegs have lower engagement surfaces for engagement with said guide tracks;

said guide tracks have engagement surfaces for engagement with said lower engagement surfaces of said pegs;

said lower engagement surfaces of said pegs define lines parallel to said guide tracks;

said housing frame has a direction of movement from said second position to said first position; and said guide tracks extend at an acute angle relative to said direction of movement.

16. A housing frame for a sliding gate valve comprising:

a frame having a central open portion, longitudinal sides, a hole extending through said frame from said central open portion, and means for slidably supporting a sliding plate and supporting a base plate;

means for releasably coupling said frame to a manipulator; and support arms on said longitudinal sides of said frame;

wherein said support arms comprise a plurality of spring elements mounted therein.

17. The housing frame of claim 16, wherein said spring elements each comprise a guide peg and a spring surrounding said guide peg, said guide peg having a lower engagement surface extending beyond a lower surface of said support arms.

18. A housing frame for a sliding gate valve comprising:

a frame having a central open portion, longitudinal sides, a hole extending through said frame from said central open portion, and means for slidably supporting a sliding plate and supporting a base plate;

means for releasably coupling said frame to a manipulator; and support arms on said longitudinal sides of said frame;

wherein said housing frame further comprises a means for releasably coupling said frame to a molten metal vessel on one longitudinal end thereof and said means for releasably coupling said frame to a manipulator is located on another longitudinal end thereof.

19. An adapter plate for a sliding gate valve for a molten metal vessel, said adapter plate comprising:

a plate having a central opening therein, said central opening defining a means for mounting a refractory head member; and two guide tracks mounted to said plate on opposite sides of said central opening, said two guide tracks being disposed parallel to each other and adapted to mount a housing frame thereon;

wherein said two guide tracks have engagement surfaces facing upwardly toward said plate, said plate has a lower surface, and said engagement surfaces extend at an acute angle relative to said lower surface of said plate.

20. The adapter plate of claim 19, wherein said acute angle is about one to two degrees.

21. The adapter plate of claim 19, wherein said two guide tracks each have an entrance portion contiguous with said engagement surface, said entrance portion extending at an angle relative to said lower surface greater than said acute angle.

22. An adapter plate for a sliding gate valve for a molten metal vessel, said adapter plate comprising:

a plate having a central opening therein, said central opening defining a means for mounting a refractory head member;

two guide tracks mounted to said plate on opposite sides of said central opening, said two guide tracks being disposed parallel to each other and adapted to mount a housing frame thereon; and a means for engaging a gripper of a manipulator and thereby positioning the manipulator relative to said plate;

wherein said means for engaging comprises centering pegs disposed on sides of said adapter plate.

23. A manipulator for a sliding gate valve of a molten metal vessel, the sliding gate valve having a housing frame with a sliding unit and a refractory base plate therein, the housing frame having a releasable manipulator coupling on one end thereof, and an adapter plate mounting a refractory head member forming a molten metal outlet, the adapter plate having centering pegs disposed thereon, said manipulator comprising:

a manipulator support;

a gripper mounted on said manipulator support for engaging the centering pegs so as to determine the spatial position of the molten metal vessel;

an actuating cylinder mounted on said manipulator support; and a connecting means on said actuating cylinder for connecting said actuating cylinder to the releasable manipulator coupling of the housing frame so that the manipulator can move the housing frame relative to the molten metal vessel.

24. The manipulator of claim 23, wherein said actuating cylinder comprises a piston rod and said connecting means comprises a coupling socket mounted on said piston rod.

25. The manipulator of claim 23, wherein said actuating cylinder is pivotally mounted relative to said manipulator support on a horizontal axis and a cylinder unit is connected to said actuating cylinder unit such that said actuating cylinder is pivotal about the horizontal axis.

26. The manipulator of claim 23, wherein said gripper is pivotally mounted relative to said manipulator support.

27. An arrangement for a valve of a molten metal vessel, comprising:

a molten metal vessel having an outlet and guide tracks secured to said vessel extending transverse to said outlet;

a lower engagement surface at said outlet that is fixed with respect to said molten metal vessel;

a housing frame slidably mountable on said guide tracks, said housing frame having at least one refractory plate therein and a plurality of spring elements mounted therein, said at least one refractory plate being sealingly pressable into engagement with said lower engagement surface by said spring elements;

wherein said guide tracks have a predetermined length such that said housing frame, when disposed on said guide tracks, is slidable over a predetermined distance between a first position in which said housing frame positions said at least one refractory plate below said outlet of said molten metal vessel such that said at least one refractory plate is biased against said lower engagement surface by said spring elements and a second position in which said housing frame is released from said guide tracks and said molten metal vessel; and wherein said spring elements are compression spring packets that are uncompressed from initial positions due to movement of said housing frame onto said guide tracks until said housing frame is at a third position closer to said first position than said second position.

28. The arrangement of claim 27, wherein:

said housing frame comprises support arms holding said spring packets;

said spring packets are disposed between said guide tracks and said support arms to press said housing frame toward said lower engagement surface when said housing frame is in said first position; and said guide tracks and said spring packets are arranged such that said housing frame is not pressed by said spring packets due to contact with said guide tracks until shortly before said housing frame reaches said first position when moved from said second position to said first position.

29. The arrangement of claim 28, wherein said support arms have a longitudinal extent along sides of said housing frame, said spring packets are distributed along said longitudinal extent of said support arms, and said guide tracks have substantially the same longitudinal extent as said support arms.

30. The arrangement of claim 28, wherein:

said spring packets comprise guide pegs having springs disposed thereon;

said pegs have lower engagement surfaces for engagement with said guide tracks;

said guide tracks have engagement surfaces for engagement with said lower engagement surfaces of said pegs;

said lower engagement surfaces of said pegs define lines parallel to said guide tracks;

said housing frame has a direction of movement from said second position to said first position; and said guide tracks extend at an acute angle relative to said direction of movement.

31. The arrangement of claim 27, wherein said spring packets have lower surfaces that form a line parallel to an upper surface of said guide tracks and angled relative to said lower engagement surface at said outlet.

32. The arrangement of claim 31, wherein said line is angled relative to said lower engagement surface of said outlet about one to two degrees.

33. The arrangement of claim 27, wherein said third position is spaced from said first position a distance corresponding to the distance between two spring packets.

34. The arrangement of claim 27, wherein said third position is immediately before said first position.

* * * * *